US006192692B1

(12) United States Patent
Alsenz

(10) Patent No.: US 6,192,692 B1
(45) Date of Patent: Feb. 27, 2001

(54) LIQUID POWERED EJECTOR

(76) Inventor: Richard H. Alsenz, 1545 Industrial Dr., Missouri City, TX (US) 77489

( * ) Notice: Subject to any disclaimer, the term of this patent is extended or adjusted under 35 U.S.C. 154(b) by 0 days.

(21) Appl. No.: 09/017,738

(22) Filed: Feb. 3, 1998

Related U.S. Application Data

(60) Provisional application No. 60/037,185, filed on Feb. 3, 1997.

(51) Int. Cl.[7] ..... F25B 9/00

(52) U.S. Cl. ..... 62/86; 62/116; 62/402; 62/500; 62/910

(58) Field of Search ..... 62/910, 402, 500, 62/116, 86, 87

(56) References Cited

U.S. PATENT DOCUMENTS 3,628,342 * 12/1971 Becker ..... 62/910
4,378,681 * 4/1983 Modisette ..... 62/5
4,594,084 * 6/1986 Lopez ..... 62/910
5,240,384 8/1993 Tuzson ..... 417/185
5,305,610 * 4/1994 Bennett et al. ..... 62/910
5,309,736 * 5/1994 Kowalski et al. ..... 62/500
5,347,823 9/1994 Alsenz ..... 62/116
5,444,987 8/1995 Alsenz ..... 62/116
5,497,635 3/1996 Alsenz ..... 62/502
5,647,221 7/1997 Garris, Jr. ..... 62/116
5,682,759 * 11/1997 Hays ..... 62/402

* cited by examiner

*Primary Examiner*—Ronald Capossela

(57) ABSTRACT

Continuous cooperative isobaric ejector method, process and apparatus are disclosed. The ejector compressor 10*a* is used as a primary compression source in a refrigeration system. The isobaric expansion is accomplished by centrifuging the liquid during the process of evaporation. The vapor evaporated from the liquid as it becomes progressively sub-cooled is used to power a novel continuous spiral ejector 25 compressor. The continuous isobaric ejector 10*b* is also used to replace the free expansion at the expansion valve.

13 Claims, 9 Drawing Sheets

LIQUID POWERED EJECTOR

CROSS-REFERENCE TO RELATED APPLICATIONS

This application is based on provisional application 60/037,185, filed Feb. 3, 1997, entitled "Venturi Jet Compressor", which is incorporated herein by reference in its entirety.

FIELD OF THE INVENTION

My present invention pertains to the field of ejector compressors and pumps. More particularly described within is the application of ejector compressors as applied to the refrigeration art; the invention however has application beyond the refrigeration art.

BACKGROUND OF THE INVENTION

The current invention allows for a continuous expansion process and continuous cooperative bombardment of particles to be utilized in the transport of particles from an energy level to a higher energy level.

Attempts have been made to use ejector compressors in refrigeration systems as described in U.S. Pat. No. 5,647,221 and the current inventor's U.S. Pat. No. 5,444,987.

U.S. Pat. No. 5,647,221 discloses an ejector-refrigeration system, and a method of utilizing the injector as the compressor in a refrigeration system is disclosed. The system is particularly well suited for the utilization of energy sources such as waste heat from automobile engines and solar collectors. Further, the system is compatible with the use of environmentally benign refrigerant such as water. Unlike conventional ejectors, the ejector disclosed is designed to utilize the principal of "pressure exchange" and is therefore capable of attaining higher levels of performance than conventional ejectors whose operating mechanism is based on the principal of "turbulent mixing". The pressure exchanging ejector with a compressible working fluid utilizes the oblique compression and expansion waves occurring within jets emanating from the discharges of a plurality of supersonic nozzles so as to impart energy to a secondary gaseous fluid wherein the said waves are caused to move relative to the housing of said ejector by virtue of a motion inducing means applied to said nozzles, said nozzles being incorporated in a rotor. The pressure exchanging ejector is utilized as an ejector-compressor with a vapor-compression refrigeration system whereby said working fluid constitutes the refrigerant.

U.S. Pat. No. 5,444,987 discloses a refrigeration system which utilizes a portion of the energy of the condensate liquid to elevate the pressure of the gas in the suction line above the evaporator pressure is disclosed. A jet enthalpy compressor is used as a means for elevating the suction line pressure. The refrigeration system contains a reservoir which stores liquid and gas refrigerants. The liquid refrigerant from the reservoir passes to an evaporator wherein it evaporates to a low-pressure gas, which is discharged into the suction line. A jet enthalpy compressor is disposed between the reservoir and the suction line. The jet enthalpy compressor contains ejectors, each ejector having a nozzle end placed in the suction line. Gas refrigerant from the reservoir is controllably discharged into the suction line through the nozzle ends of the ejectors to elevate the pressure in the suction line. The gas through the ejectors may be pulsed to further improve the efficiency of the refrigeration system.

In U.S. Pat. No. 5,240,384 Tuzson discloses an ejector for use in a refrigeration system has a mixing tube or diffuser which is partitioned into multiple flow passages. Selectively directing a continuously flowing primary high velocity fluid jet stream, which stream entrains a secondary fluid, cyclically into each of the multiple flow passages creates a pulsing of the primary high velocity fluid jet stream with respect to each flow passage. Pulsing the primary high velocity fluid jet stream in this manner enhances the mixing and compression of the primary high velocity fluid jet stream and the secondary fluid in the diffuser.

Inventor's U.S. Pat. No. 5,444,987 discloses a refrigeration system which utilizes a portion of the energy of the condensate liquid to elevate the pressure of the gas in the suction line above the evaporator pressure. Several problems exist which had not been realized. First, the process is costly because of the numerous stages and controls which become necessary to practice the invention. Secondly, the staged ejector compressors each have the same associated inefficiencies which means that the succeeding stages must overcome the added work induced by the preceding stage inefficiencies i.e., the added amount of refrigerant must be handled because of the preceding stages requirements.

U.S. Pat. No. 5,647,221 attempts to solve the problem of doing wasted work and overcoming the turbulence with the use of rotor blades. This approach results in a costly and not altogether sufficient answer to the problem.

OBJECTS AND ADVANTAGES OF THE INVENTION

It is the objective of the invention to provide an ejector compressor which over come deficiencies of the prior art.

It is the objective of the invention to provide a reversible expansion process which may be used to replace the free expansion at an expansion valve in a liquid expansion process.

It is a further objective of the invention to provide a continuous ejector process which will reduce the amount of turbulence.

It is a further objective of the invention to provide a continuous ejector process which will reduce the amount of useless work done on holding back the bombarding particles.

It is a further objective of the invention to provide a continuous ejector process which will utilize a reversible isobaric process for the generation of the primary particles in a refrigeration ejector compressor.

It is a further objective of the invention to provide a continuous cooperative ejector process which will transport particles through the annulus of a cylinder by bombarding secondary particle stream by a primary particle stream from within the annulus and from the outside of the annulus in a way which will transport the secondary stream to a higher pressure.

It is a further objective of the invention to provide a continuous ejector process which will allow the use of a ejector process in the air-conditioning of a vehicle by using the waste heat from the engine.

Further objects and advantages of my invention will become apparent from a consideration of the drawings and ensuing description. The problem of expanding a liquid from a high pressure to a lower pressure in a reversible way has not been solved and as a consequence the major inefficiencies in today's commercially available refrigeration systems is the free expansion across the expansion valve. The term free expansion is therefor a misnomer because of its inefficiency. It should more appropriately be called wasted expansion.

The prior art has focused on solving the inefficiencies of the staged ejector by pulsing the ejector, the current invention helps solve the problem by providing a continuous stream of particles of less energy following behind each other. This allows the turbulence between the staging to be done in gradual way which improves the efficiency above what any one ejector could achieve on its own.

BRIEF DESCRIPTION OF THE DRAWING FIGURES

The following drawings will aid in the description of preferred embodiments of the current invention.

Figure 1:
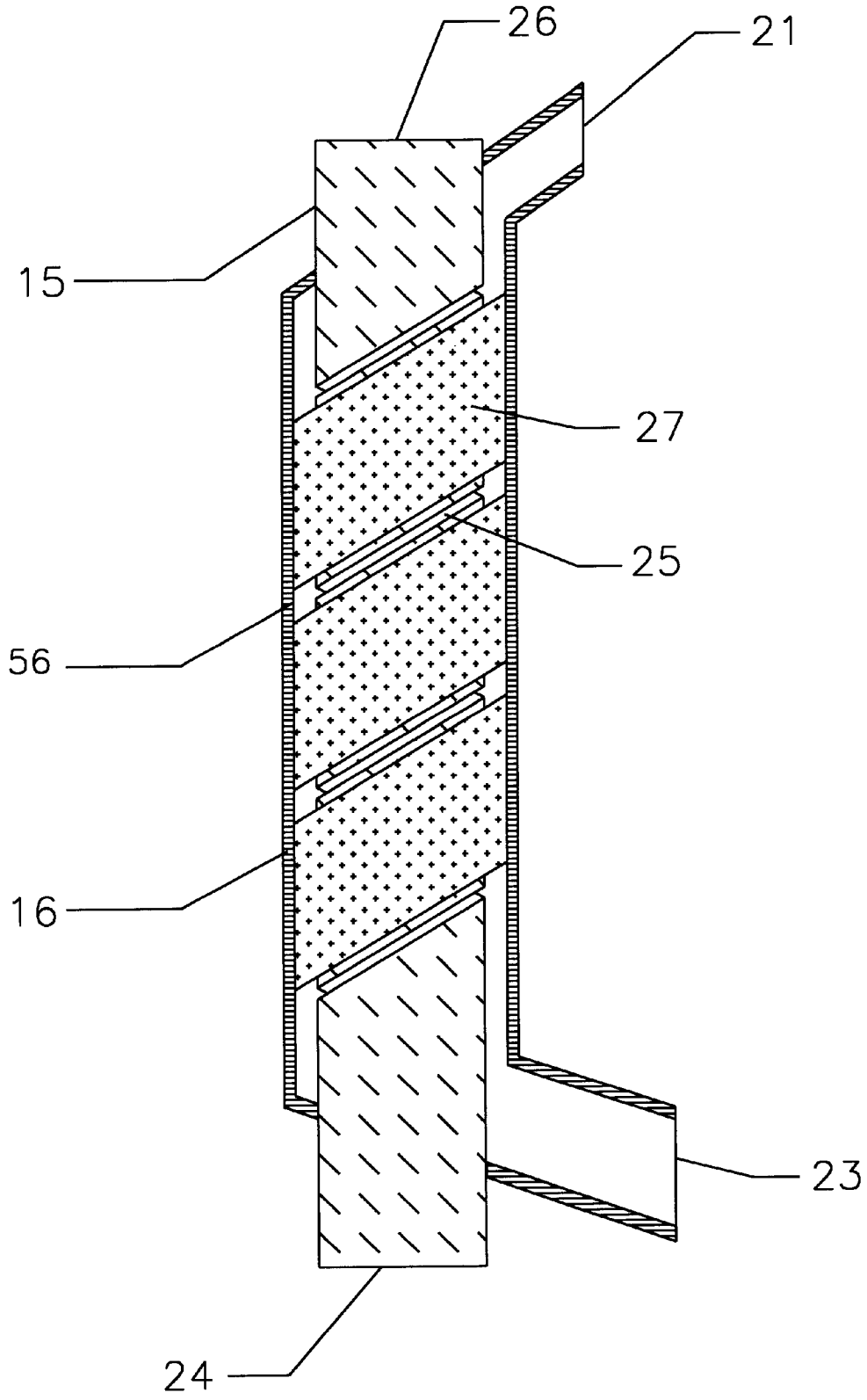
FIG. 1 is a partial side view cross-sectional drawing of the liquid powered continuous ejector compressor or pump of my disclosed invention.

| Brief Description of the Numerals | |
|---|---|
| 10 | ejector jet compressor |
| 10a | ejector jet compressor |
| 10b | ejector jet compressor |
| 14 | inner-inner tube |
| 15 | inner tube |
| 16 | outer tube |
| 21 | inlet of primary liquid |
| 22 | pressure feed through to inner tube |

-continued

| Brief Description of the Numerals | |
|---|---|
| 23 | outlet |
| 24 | inlet of secondary stream |
| 25 | ejector slot |
| 25a | ejector slot |
| 26 | outlet of secondary stream |
| 27 | partition |
| 50 | inside of inner-inner tube |
| 55 | inner annulus |
| 56 | outer tube annulus |
| 101 | condenser |
| 102 | liquid receiver |
| 103 | liquid pump |
| 104 | evaporator area |
| 105 | boiler |
| 121 | return suction tube from evaporator |
| 122 | discharge tube |
| 123 | liquid supply tube to receiver |
| 124 | liquid tube leaving receiver |
| 125 | supply tube to boiler |
| 126 | liquid supply tube to evaporator |
| 127 | discharge from boiler |
| 131 | control valve to boiler |
| 132 | expansion valve |
| 133 | metering valve |
| 135 | liquid boiler supply tube to control valve |
| 137 | evaporator liquid supply tube from ejector |
| 141 | outlet evaporator sensor for valve 132 |
| 142 | air temperature sensor for valve 132 |
| 151 | evaporator fan |
| 152 | condenser fan |
| 161 | expansion valve prior to 10b |
| 190 | suction tube to compressor |
| 200 | boiler control sensor |
| 201 | Temperature control probe |
| 202 | Micro-controller |
| 203 | Input to Micro-controller |
| 204 | Output of Micro-controller |
| 210 | compressor |
| 220 | compressor |
| 230 | compressor |
| 240 | inlet compressor manifold |
| 250 | outlet compressor manifold |
| 260 | alternate systems |
| 270 | alternate systems |
| 280 | alternate systems |
| 290 | alternate system suction tube |

SUMMARY OF THE INVENTION

The current invention discloses a method of isobaric expansion. The isobaric expansion is accomplished by applying a centrifugal force on the liquid used as the refrigerant as it is expanded. As the liquid is centrifuged it is expanded in the center of the centrifuge. The vapor from the isobaric expansion is used to power a continuous ejector compressor. As the expansion takes place continuously the liquid travels through the centrifuge it becomes colder making cooler vapor available to the continuous ejector as it progresses through the centrifuge.

The continuous ejector compressor has a spiral grove for ejecting the primary particles to the process. The spiral ejector being continuous, allows for low turbulence between staged areas because the adjacent jet streams have small differences in their velocities thus a continuous low turbulence though the entire ejector is accomplished. The efficiency of the succeeding spirals allows for efficiencies not possible with conventional staged ejector compressors due to the minimized turbulence and the fact that the work to hold back the bombarding particles at the outlet is done only at the outlet of the ejector. Thus the preceding stages of the ejector do not suffer the same magnitude of inefficiency. An alternative method of accelerating the particles in the secondary stream is to have a progressive series of slots or holes instead of the spiral grove.

The continuous ejector and the continuous cooperative ejector may also be utilized as the main compressor without the isobaric process by supplying it with vapor produced by a boiler instead of liquid. The boiler may be from any heat source such an automobile engine, a solar collector or a gas burner etc.

PREFERRED EMBODIMENTS

FIG. 1 is a cross-sectional view of a continuous isobaric ejector compressor. An inner tube 15 provides for the secondary particle stream transport from a pressure at inlet 24 to a higher pressure at outlet 26. The outer tube 16 receives a primary liquid, e.g. refrigerant, through inlet 21. The liquid is injected into the outer tube 16 in a manner which promotes the rotation of the fluid in the outer tube annulus 56 . Since the liquid is denser than the vapor, the liquid will be propelled around the outer wall of tube 16 and a pressure will be created against the wall which is greater than the pressure of the inner gas at the center portions of tube 16. The liquid traveling against the wall will be in a sub-cooled state and at positions closer to the center of outer tube 16, gas will be escaping from the liquid into the ejector slot or grove 25 which is configured such that the particles are directed both toward the inner center of tube 15 and towards the outlet 26. Since the pressure in tube 15 is lower than tube 16, the particles will be accelerated toward the outlet end 26. These particles will have a general momentum in the direction of the outlet 26 which is greater that the secondary particles entering tube 16 at 24. The collisions which take place between the primary fluid and the secondary fluid will tend to accelerate the secondary fluid to a higher pressure as they progress through tube 16 and the primary fluid will lose some of its energy in the collision process.

The ejector slot or grove 25 is cut in a spiral such that the adjacent portions of the spiral are separated from each other by small distances. The partition 27 allows the liquid to be partitioned as it progresses through outer tube 16 that allow the pressure drop across the inner surface of the liquid to be reduced. The partition 27 may extend from the inner wall of inner tube 15 to the liquid or it may extend to touch the outer wall or housing of outer tube 16. Since the liquid which moves along against the outer wall of outer tube 16 gets progressively colder as it continues towards outlet or exit 23, the vapor which is boiled off is progressively a lower pressure as it approaches the outlet 23. This means that the primary particles differ slightly in energy as they go through adjacent portions of the spiral ejector into the inner tube 15 and they become less energetic the closer they are to exit 23. This means that the turbulence relative to each adjacent portion of the spiral is smaller than if there had been only one grove circumventing tube 15. Additionally, since the only portion of the spiral seeing the higher-pressure particles bombarding back in the annulus of inner tube 15 is the final portion of the spiral, the amount of wasted work is minimized.

The continuous ejector depicted in FIG. 1 may also be used with a gas supply as the source of the primary fluid, with or without partition 27. Typical applications might be the applications mentioned in U.S. Pat. No. 5,647,221 as the main compressor.

Figure 2:
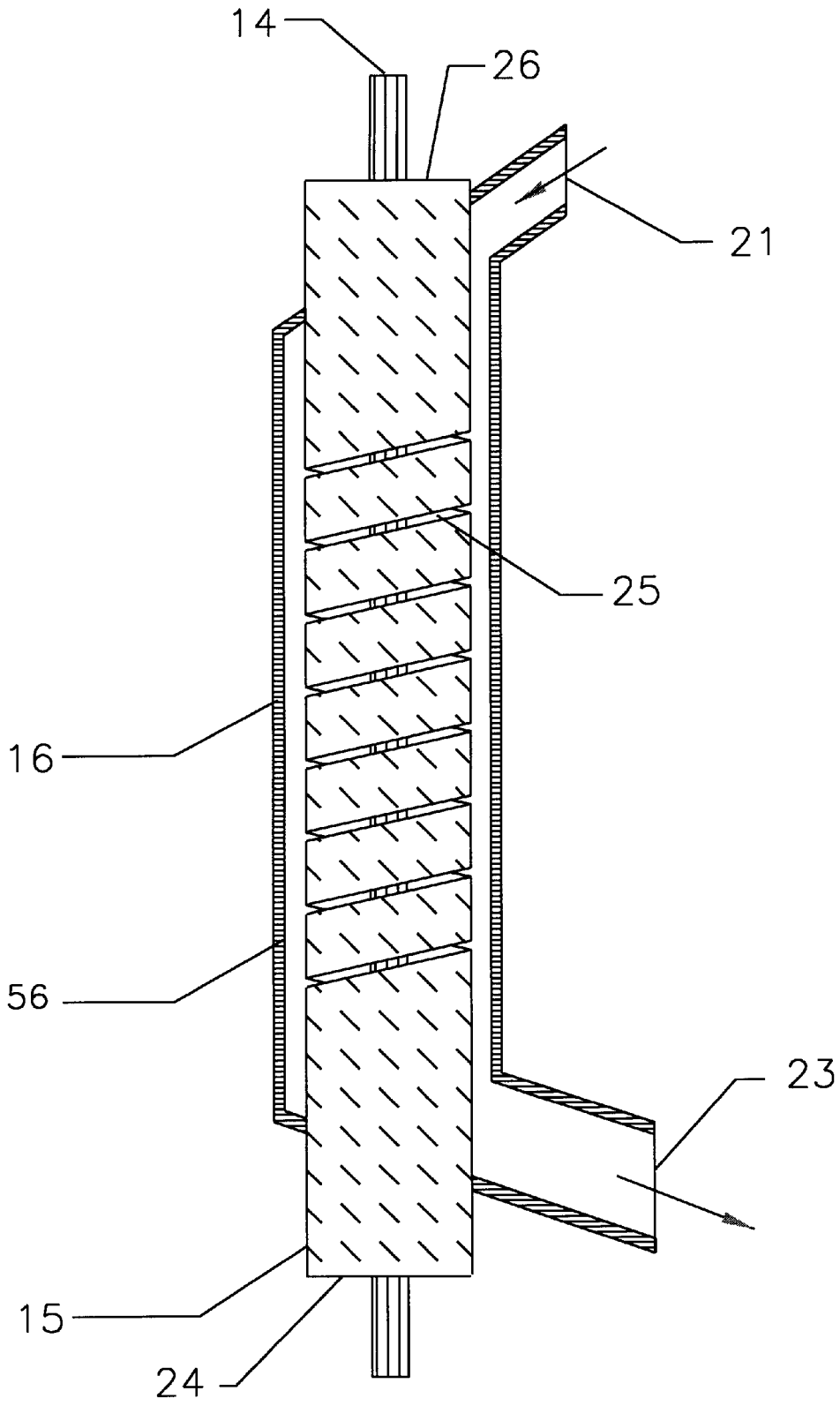
FIG. 2 is a partial side view cross-sectional drawing of a liquid or vapor powered cooperative version of the continuous ejector compressor or pump of my disclosed invention.
Figure 3:
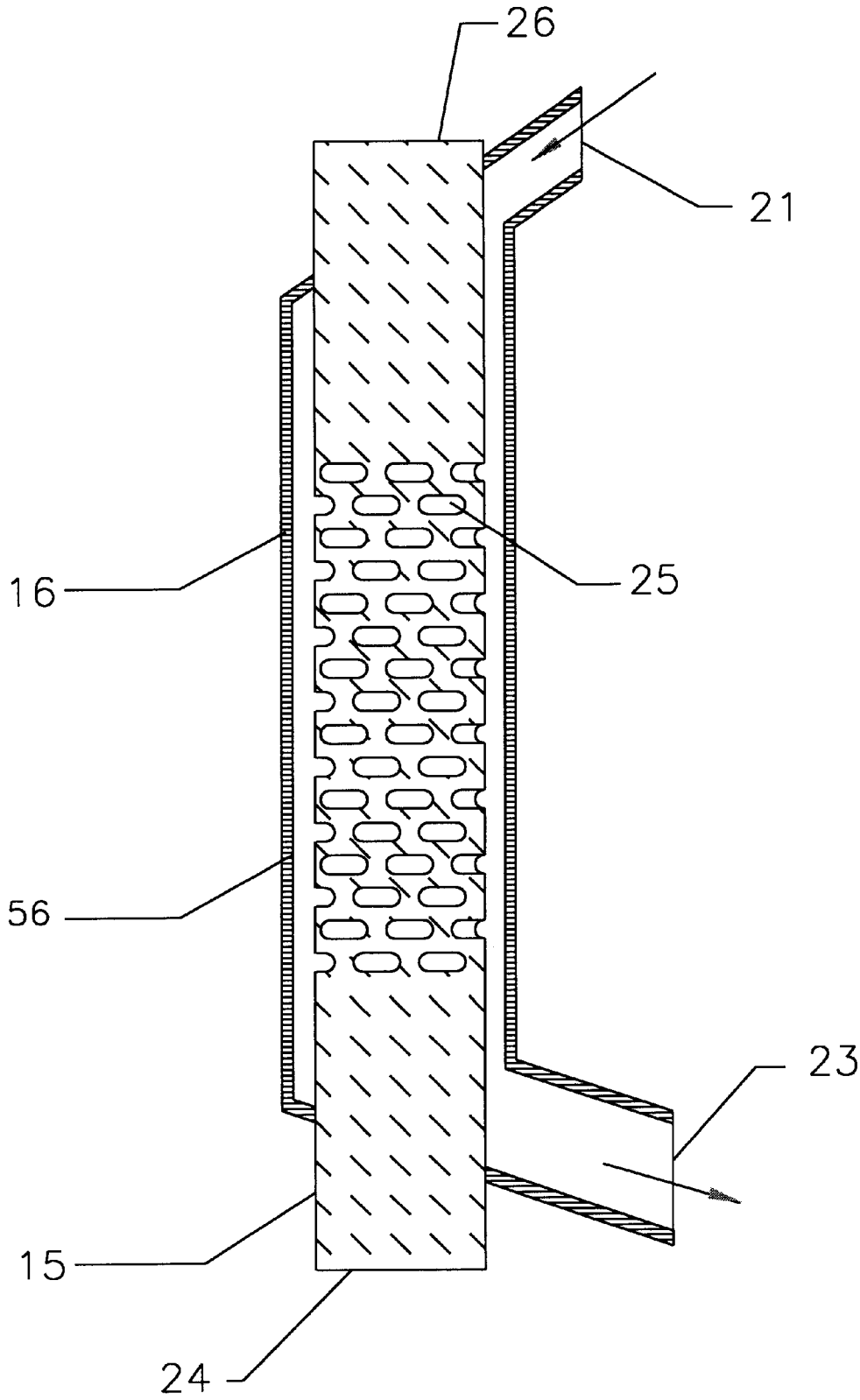
FIG. 3 is a partial side view cross-sectional of the cooperative version of the continuous intake with slotted ejector compressor or pump of my disclosed invention.
Figure 5:
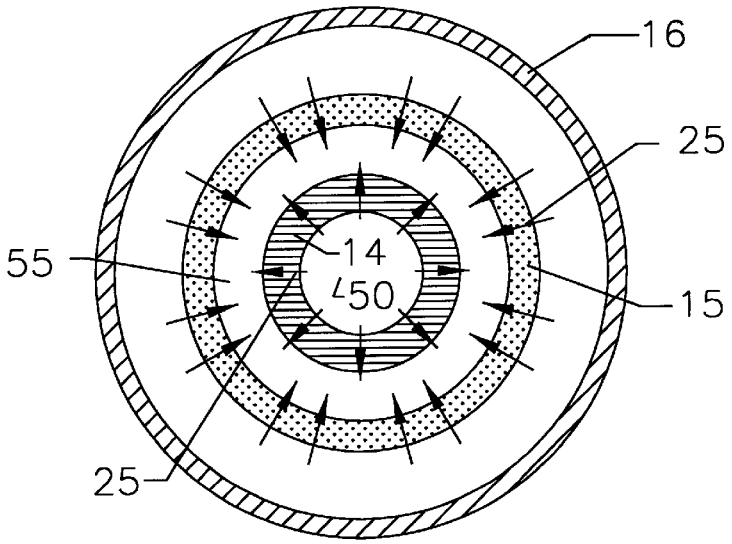
FIG. 5 is a further cross-sectional end view along line 5—5 of FIG. 4.
Figure 4:
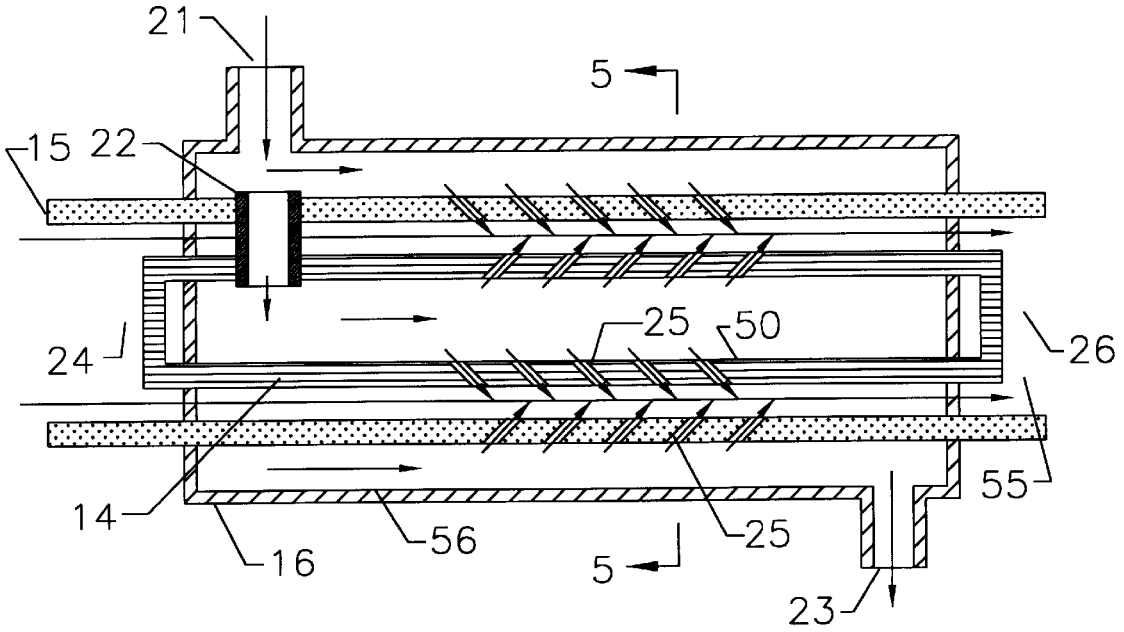
FIG. 4 is a cross-sectional side view drawing of the internal chambers of the cooperative version of the continuous intake with continuous ejector compressor or pump of my current disclosed invention.

FIG. 2 and FIG. 4 are a cross-sectional views of a continuous cooperative ejector. They differ from FIG. 1 in that they have an inner tube 50 which is within tube 15. The inner tube is hooked up pressure wise with the inner pressure of tube 16 via entry tube 22. The continuous cooperative ejector may be used with a liquid or vapor as the supply. If the ejector is used with vapor as the supply as in FIG. 9 or 10, a outlet or exit tube 23 would not be necessary. A secondary stream of particles entering into the inlet of secondary stream 24 is exposed to being hit by primary particles from the bombarding of particles ejected through the ejector slot 25 of inner-inner tube 14 or the inner tube 15. This also reduces the amount of turbulence in the process of bombardment. FIG. 5 is a further cross-sectional end view of the continuous cooperative ejector. FIG. 2, 3, 4 and 5 differ from FIG. 1, also in that the partition 27 is not present; however, it could be included or not and still be within the scope of the invention.

In FIG. 3 the spiral slot 25 is replaced by numerous individual slots. The slots may be made by cutting slots, drilling holes or could be circumvental slots.

Figure 6:
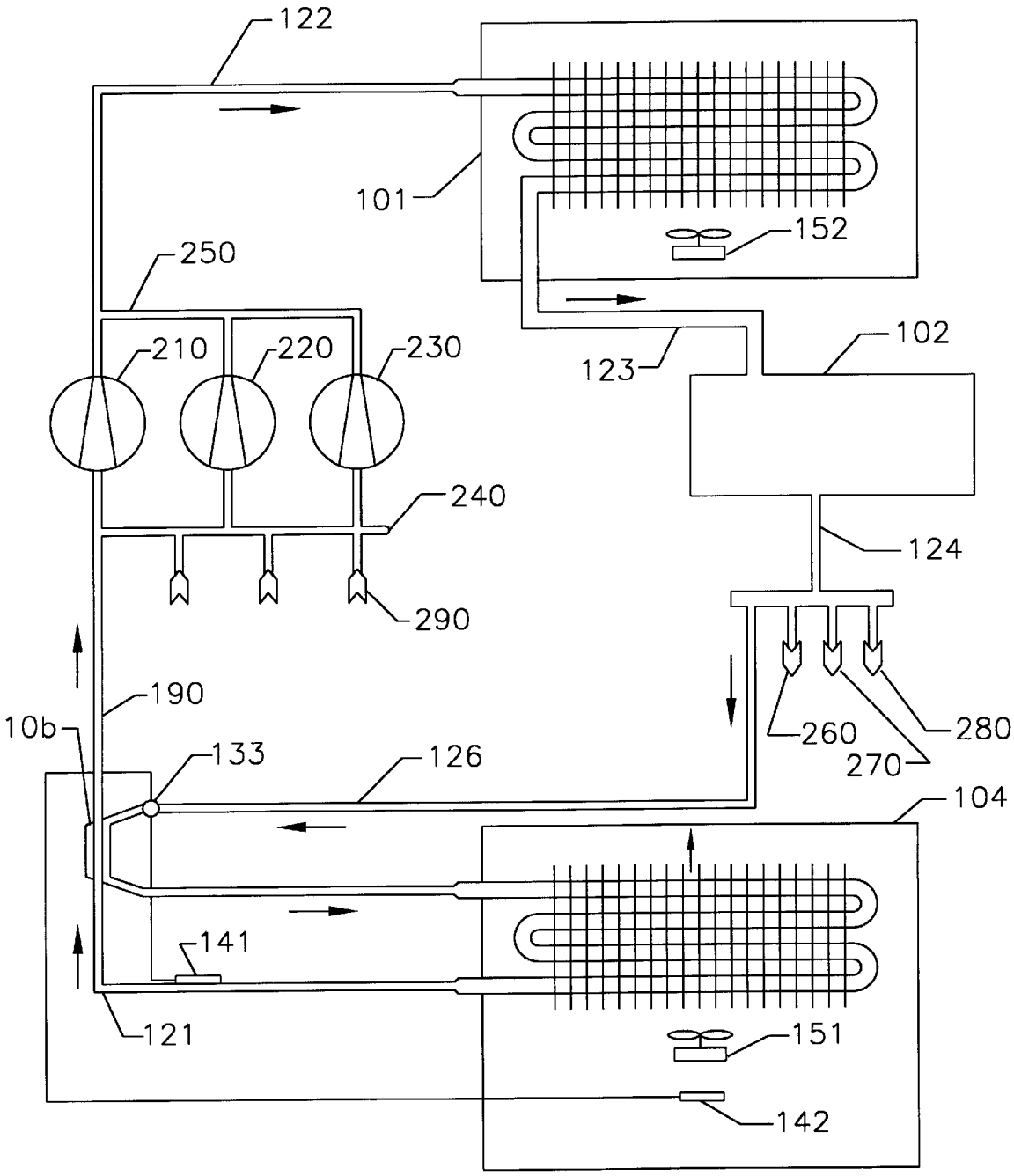
FIG. 6 is a schematic of a conventional refrigeration system modified to utilize the liquid powered continuous ejector compressor in the refrigeration expansion and compression process.

FIG. 6 is a schematic of a refrigeration system utilizing an embodiment of the present invention. Compressors 210, 220 and 230 discharge gas through discharge tube 122 to the condenser 101 which is cooled by air being moved across the condenser coils by fan 152. The hot high-pressure gas is cooled to a point equal to the condensing temperature and gas begins to condense and liquid begins to precipitate. The liquid is transported to the receiver 102 by liquid supply tube 123. The liquid is transported out of receiver 102 by liquid supply tube 124 and is distributed to alternate systems 260, 270 and 280 (the details of which are not shown). The system with evaporator 104 is shown and liquid is transported to a metering valve 133 by liquid supply tube 126. Liquid enters the continuous ejector **10*b* and is centrifuged against the outer walls. The vapor in the center of the continuous ejector 10*b* is used as a source of primary high energy particles to eject at high velocities into the suction tube 121 in the direction of the compressors 210, 220 and 230. Liquid in ejector 10*b* is centrifuged and exits the ejector and is transported to the evaporator 104. The liquid will enter the evaporator 104 considerably colder than it left the condenser. Thus, the energy that would have been used to cool the liquid to the coil temperature in a conventional refrigeration system has now been utilized to elevate the suction pressure, making the overall system much more efficient. The liquid is at a lower pressure which is provided by the compressors 210, 220 and 230 and ejector compressor 10*b*. The evaporator fan 151 blows warmer air across the evaporator coil, warming the evaporator coil, and this produces a boiling which adsorbs energy from the evaporator coil. The gas is transported at a low pressure by tube 121 to the continuous isobaric ejector compressor 10*b* where the pressure is elevated by the bombarding particles from the primary stream. The gas is transported to the compressors 210, 220 and 230 by tube 190. The compressors 210, 220 and 23** compress the gas and the process begins again.

Figure 7:
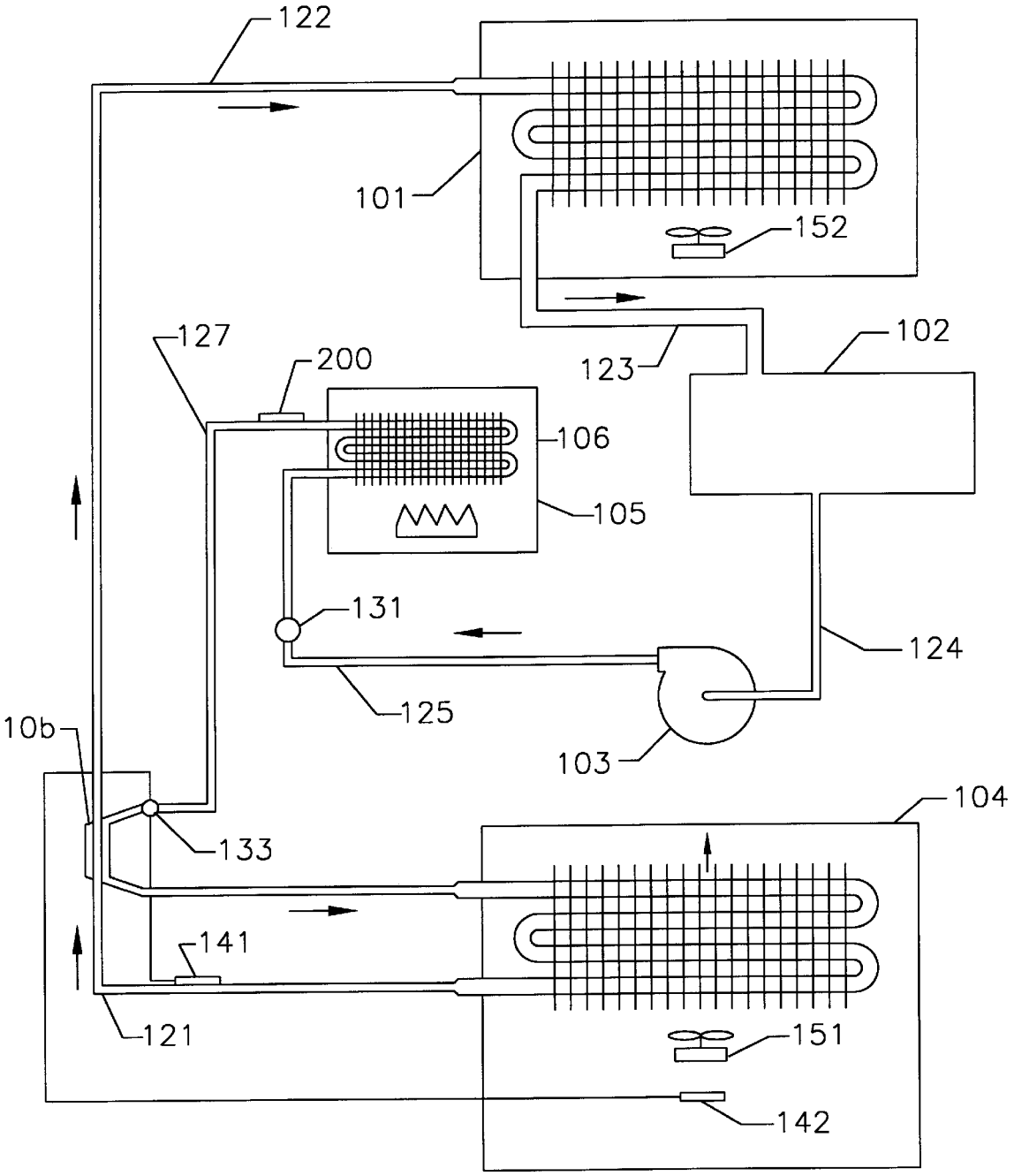
FIG. 7 is a schematic of a refrigeration system utilizing an liquid powered continuous ejector compressor which is powered by a boiler which supplies hot liquid to it and the liquid powered continuous compressor then supplies liquid to a refrigeration evaporator.
Figure 8:
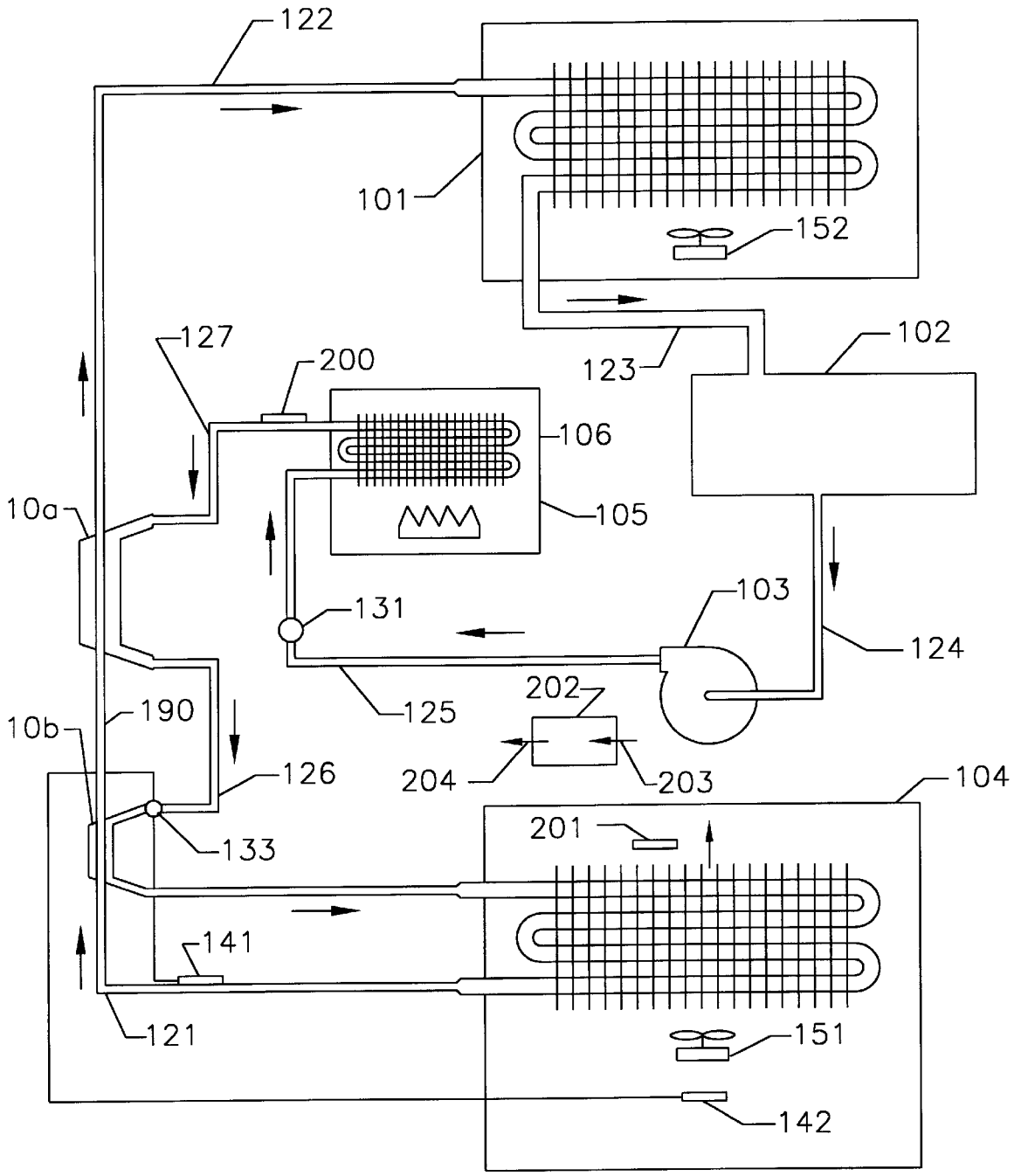
FIG. 8 is a schematic of a refrigeration system utilizing an liquid powered continuous ejector compressor and an liquid powered continuous ejector compressor which is powered by a boiler.

FIG. 8 is a schematic similar to FIG. 6 except it has the compressors 210, 220 and 230 replaced with a boiler 105 and continuous isobaric ejector compressor **10*a*. Liquid is transported from the receiver 102 to pump 103 by tube 124. The pump transmits liquid at a higher pressure to boiler 105 through tube 125. The boiler raises the pressure which is maintained at a level to insure that the temperature required at temperature sensor 201 is adequate. The liquid leaving the isobaric compressor 10*a* is transported to continuous isobaric compressor 10*b*. The remainder of the process is now the same as described in FIG. 6. The process may be controlled by a micro-controller 202 which receives information form sensors 200, 201 and others through inputs 203. The micro-controller controls the valves, pumps and fans through outputs 204. FIG. 7 differs from FIG. 8 in that the continuous isobaric compressor 10***a* is not used. If multiple or different coil temperatures are required on one system then multiple isobaric compressors in series become practical solutions.

Figure 9:
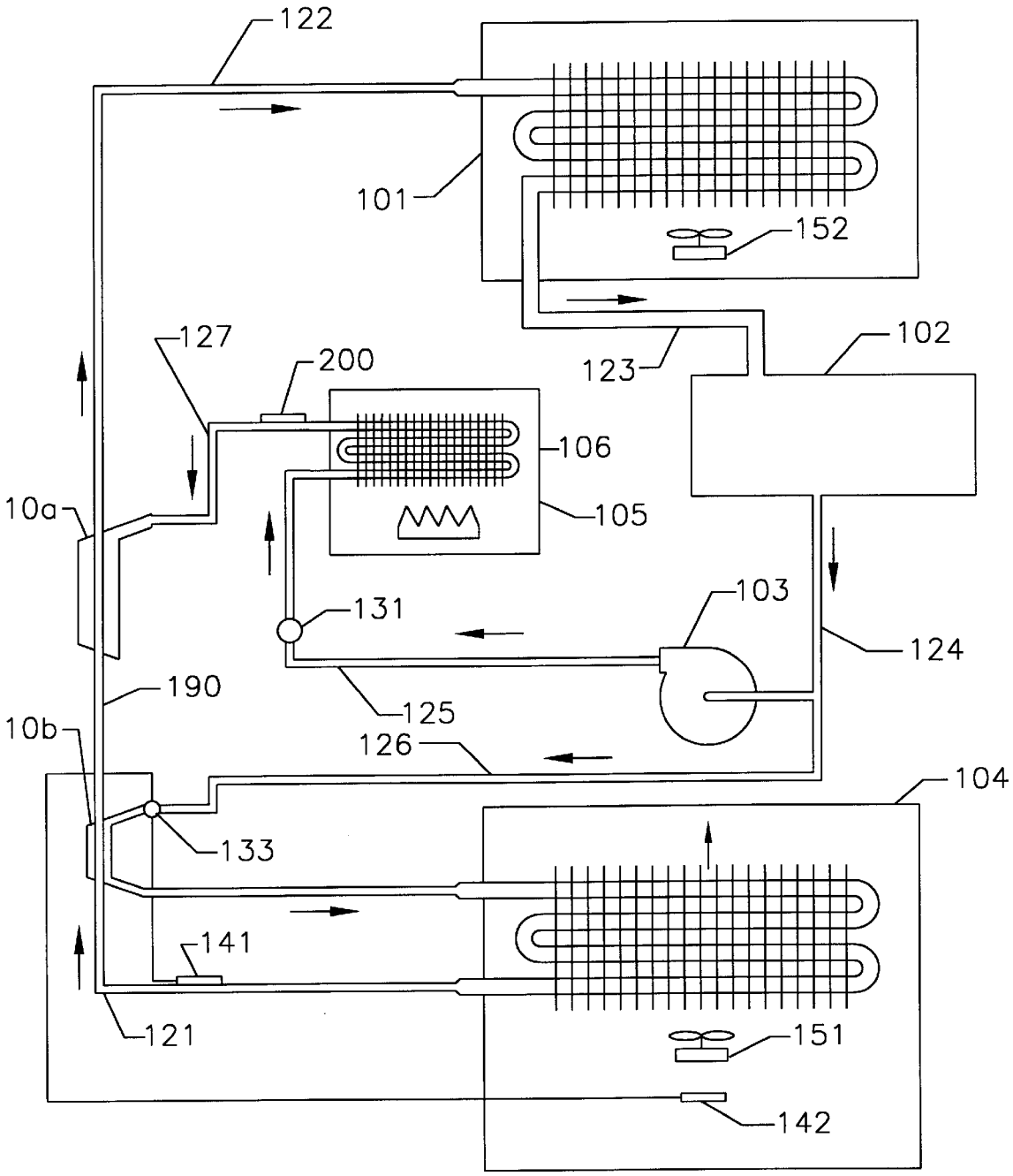
FIG. 9 is a schematic of a refrigeration system utilizing an liquid powered continuous ejector compressor for the expansion of liquid to the evaporator and a gas powered continuous ejector compressor which is powered by a boiler as the primary compressor.

FIG. 9 differs from FIG. 8 in compressor 10*a* is not isobaric. The fluid from the boiler is entirely gas. The remainder of the system is identical to FIG. 8. The cooperative feature of the disclosed invention shown in FIGS. 4 and 5 can be used with or with out the isobaric feature.

Figure 10:
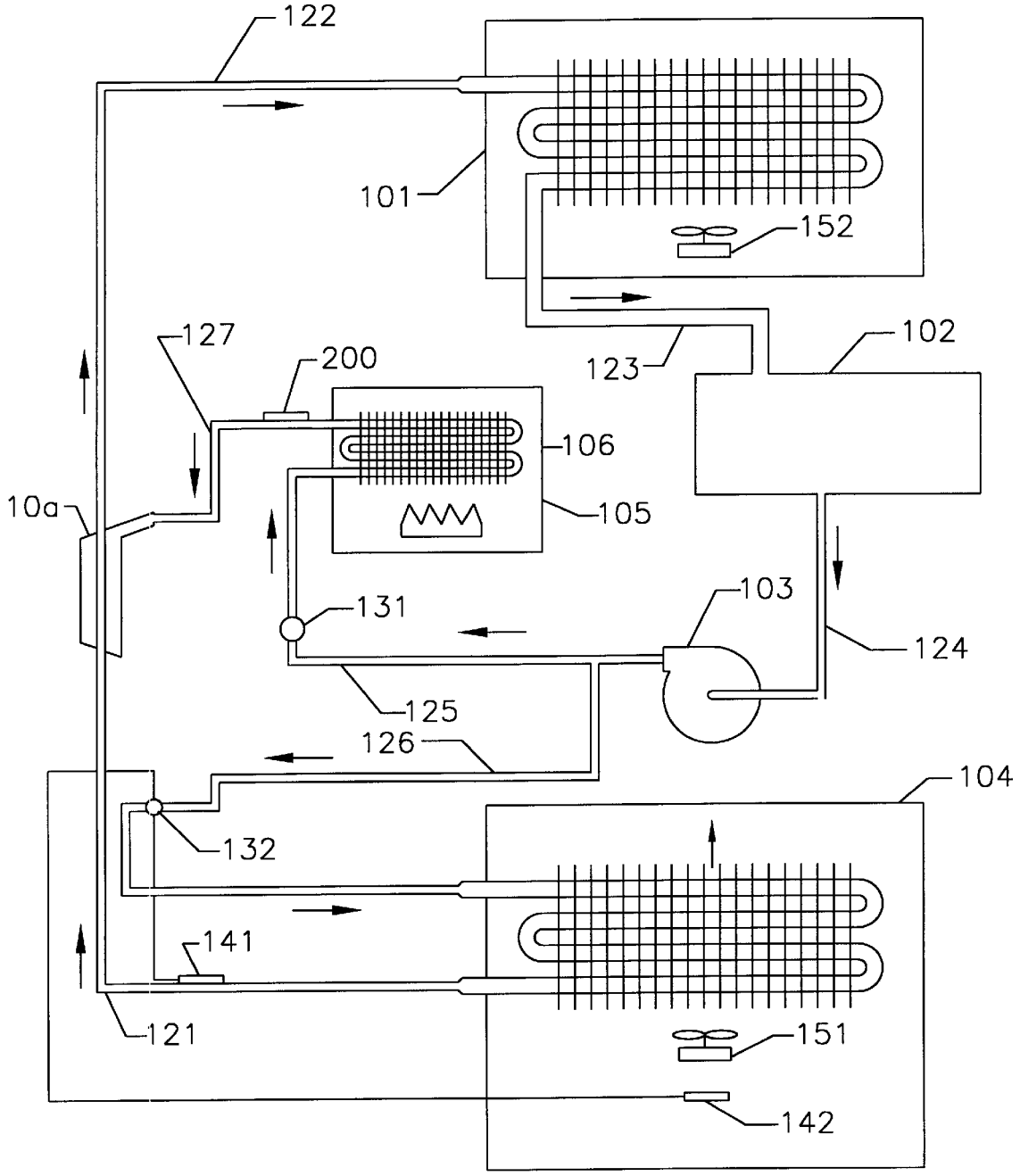
FIG. 10 is a schematic of a refrigeration system utilizing an gas powered continuous ejector compressor and a conventional expansion valve for distributing the liquid refrigerant to the evaporator.

FIG. 10 differs from FIG. 9 in that the isobaric compressor at the evaporator 10*b* is not used.

Theory of Operation

The method of achieving isobaric expansion and accomplishing work has been described herein. The process involves centrifuging the high-pressure condensate liquid to achieve the pressure which insures that it remains condensed against the wall. The vapor is allowed to expand at the inner surface of the liquid. This allows the liquid to remain in a sub-cooled state against the wall. A method of utilizing the expanded refrigerant has been described which involves ejecting the molecules through a continuous ejector spiral slot. A cooperative inner continuous ejector slot has also been disclosed which participates in a cooperative manner with the outer continuous ejector spiral slot. It should be obvious that other types of venturi processes could be used in combination with the isobaric expansion process and the ones described herein are meant to serve as a guide to accomplishing this. It is also intended that this process could be used for sources of power in other types of compressors and it is hoped that this text will guide others to achieving improvements on this invention which will utilize the myriad of compressor types available today.

While my above description contains many specificities, these should not be construed as limitations on the scope of the invention, but rather as an exemplification of one preferred embodiment thereof. Many other variations are possible. For example, the method of isobaric expansion disclosed is intended to apply to all uses of the vapor produced by the novel isobaric expansion process and should not be limited to the simple use as the source of particles for a continuous ejector. For example, the application of the particles to any ejector is intended to be within the scope of this invention. It is also intended that the scope of this invention is applicable to any type of use of the particles such as powering a compressor as described in my U.S. Pat. Nos. 5,497,635, and 5,347,823. The use of some of the innovative ejector concepts introduced here certainly has application outside of and beyond the isobaric process. For instance, the continuous and the cooperative ejector concepts can and have been described used without the isobaric process. It is intended that the invention described herein apply to all such processes and that this invention not have a limitation which I have not acknowledged through the written words of this document or its following file wrapper history. Accordingly, the scope of the invention should be determined not by the embodiment(s) illustrated, but by the appended claims and their legal equivalents.

What is claimed is:

1. A method for achieving an isobaric expansion process comprising:

supplying liquid at a high pressure and temperature, causing the liquid to rotate producing a centrifugal force on the liquid, allowing the inner layer of liquid to evaporate from successively colder portions of the liquid and utilizing the vapor pressure from the successively colder portions of the liquid to perform useful work.

2. The method as described in claim 1 wherein the liquid is rotated in a cylinder.

3. The method as described in claim 2 wherein the liquid enters one end of the cylinder and exits the other end of the cylinder.

4. The method as described in claim 3 wherein an inner cylinder having ejector slots is concentric with said cylinder and the vapor produced by the vapor pressure of said liquid is passed through an inner cylinder through said ejector slots a manner which will produce movement in one direction within said inner cylinder.

5. The method as described in claim 4 wherein the ejector slots are helix.

6. The method as described in claim 5 wherein the helix is continuous.

7. The method as described in claim 4 wherein the slots circumvent the inner cylinder.

8. The method of claim 4 wherein an inner-inner cylinder is concentric with the inner cylinder and has ejector slots in a manner which will produced movement in one direction within the annulus created by the inner cylinder and the inner-inner cylinder.

9. The method of claim 4 wherein the slots are partitioned.

10. An ejector comprising:

an outer member having an inlet end and an outlet end;

a first inner member concentric within said outer member and extending through said outer member, said first inner member having a wall forming a passageway through said first inner member, the passageway having an inlet end and an outlet end; and an ejector slot extending a selected distance along the wall of said first inner member to eject gas from said outer member into said passageway and out the outlet end of said passageway.

11. The continuous ejector of claim 10 wherein said slot is a single helix.

12. The continuous ejector of claim 10 wherein said slot is a plurality of openings.

13. The continuous ejector of claim 10 further comprising:

a second inner member concentric within said first inner member and said outer member, said second inner member having an inlet end and an outlet end; and an ejector slot extending a selected distance along the wall of said second inner member to eject gas from said second inner member into said passageway and out the outlet end of said passageway.

* * * * *